US006971736B2

(12) United States Patent
Tomizawa et al.

(10) Patent No.: US 6,971,736 B2
(45) Date of Patent: Dec. 6, 2005

(54) INK JET RECORD HEAD

(75) Inventors: Keiji Tomizawa, Kanagawa (JP); Shuichi Murakami, Kanagawa (JP); Mitsuhiro Matsumoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/614,159

(22) Filed: Jul. 8, 2003

(65) Prior Publication Data

US 2004/0130598 A1 Jul. 8, 2004

(30) Foreign Application Priority Data

Jul. 10, 2002 (JP) ..... 2002-201878
Jul. 7, 2003 (JP) ..... 2003-271626

(51) Int. Cl.[7] ..... B41J 2/05; B41J 2/135; B41J 2/14

(52) U.S. Cl. ..... 347/61; 347/44; 347/47

(58) Field of Search ..... 347/20, 44, 47, 347/54, 56, 61–65

(56) References Cited

U.S. PATENT DOCUMENTS

| | | | | |
|---|---|---|---|---|
| 4,587,534 A | | 5/1986 | Saito et al. | |
| 4,694,308 A | * | 9/1987 | Chan et al. | 347/65 |
| 5,218,376 A | | 6/1993 | Asai | |
| 6,137,510 A | | 10/2000 | Sato et al. | |
| 6,286,933 B1 | | 9/2001 | Murakami et al. | |
| 6,350,016 B1 | | 2/2002 | Tachihara et al. | |
| 6,439,696 B1 | | 8/2002 | Murakami et al. | |
| 6,443,561 B1 | | 9/2002 | Murakami | |
| 6,520,626 B1 | | 2/2003 | Murakami | |
| 6,540,335 B2 | | 4/2003 | Touge et al. | |
| 6,659,588 B2 | * | 12/2003 | Ikegame et al. | 347/40 |
| 6,685,301 B2 | * | 2/2004 | Eida et al. | 347/45 |
| 2001/0050704 A1 | | 12/2001 | Tachihara et al. | |
| 2002/0054181 A1 | | 5/2002 | Murakami | |
| 2002/0196299 A1 | | 12/2002 | Murakami | |
| 2003/0058305 A1 | | 3/2003 | Murakami et al. | |
| 2003/0067508 A1 | | 4/2003 | Mitzutani et al. | |

FOREIGN PATENT DOCUMENTS

| | | |
|---|---|---|
| EP | 0 770 487 | 5/1997 |
| EP | 1 167 471 | 1/2002 |
| JP | 54-161935 | 12/1979 |
| JP | 61-185455 | 8/1986 |
| JP | 61-249768 | 11/1986 |
| JP | 4-10940 | 1/1992 |
| JP | 4-10941 | 1/1992 |
| JP | 4-29850 | 1/1992 |

* cited by examiner

*Primary Examiner*—Stephen D. Meier
*Assistant Examiner*—An H. Do
(74) *Attorney, Agent, or Firm*—Fitzpatrick, Cella, Harper & Scinto

(57) ABSTRACT

To provide an ink jet record head having a nozzle shape capable of, when further rendering liquid droplets smaller, reducing flow resistance in a discharge direction and preventing reduction in discharge speed of ink droplets.

An opening face on a bubbling chamber 11 side of a second discharge port portion 10 is shaped so that a length in a direction parallel with an arrangement direction of discharge ports 4 is longer than the length in the direction vertical thereto, and the opening face on the discharge port portion side is also a sectional shape congruent with the opening face on the bubbling chamber 11 side. In the drawing, a cross section cut in a direction approximately parallel with the surface on which heaters 1 are formed of the second discharge port portion 10 is an approximately rectangular shape.

18 Claims, 14 Drawing Sheets

INK JET RECORD HEAD

BACKGROUND OF THE INVENTION

1. Field of the Invention

The present invention relates to a liquid discharge head for discharging liquid droplets such as ink droplets and performing recording on a recording medium, and in particular, to the liquid discharge head for performing ink jet recording.

2. Related Background Art

An ink jet recording system is one of so-called non-impact recording systems. As for the ink jet recording system, noise generated on recording is almost negligible and high speed recording is possible. The ink jet recording system is capable of recording on various recording media and fixing ink on so-called standard paper without requiring a special process, and in addition, it allows a high-definition image to be obtained at a low price. Because of these advantages, the ink jet recording system is rapidly becoming widespread in recent years not only for a printer as a peripheral of a computer but also as a means of recording of a copying machine, a facsimile, a word processor and so on.

Ink discharge methods of the generally used ink jet recording system include a method of using an electrothermal converting element such as a heater as a discharge energy generating element used for discharging ink droplets and a method of using a piezoelectric element such as a piezo element as the same. Either method can control the discharge of the ink droplets by means of an electrical signal. According to a principle of the ink discharge method using the electrothermal converting element, a voltage is applied to the electrothermal converting element to instantaneously heat the ink in the proximity thereof so as to discharge the ink droplets at high speed by means of an abrupt bubbling pressure generated by phase change of the ink on boiling. On the other hand, according to the principle of the ink discharge method using the piezoelectric element, the voltage is applied to the piezoelectric element to displace it so as to discharge the ink droplets by means of the pressure generated on the displacement.

The ink discharge method using the electrothermal converting element has advantages such as no need to secure large space for placing the discharge energy generating element, a simple structure of a record head and easy integration of nozzles. On the other hand, the problems unique to this ink discharge method include change in volume of a flying ink droplets due to thermal storage of the heat generated by the electrothermal converting element and so on in the record head, an adverse effect caused on the electrothermal converting element by cavitation due to bubble disappearance, and the adverse effect caused on a discharge characteristic of the ink droplets and image quality by the air melted into the ink becoming remaining bubbles in the record head.

As for the methods of solving these problems, there are the ink jet recording systems and record heads disclosed by Japanese Patent Application Laid-Open No. 54-161935, Japanese Patent Application Laid-Open No. 61-185455, Japanese Patent Application Laid-Open No. 61-249768 and Japanese Patent Application Laid-Open No. 4-10941. To be more specific, the ink jet recording systems disclosed by the above patents laid-open have a structure wherein the electrothermal converting element is driven by a recording signal and the bubbles thereby generated is aerated to the outside air. It is possible, by adopting the ink jet recording systems, to stabilize the volume of the flying ink droplets and discharge a minute amount of the ink droplets at high speed. And it becomes possible, by resolving the cavitation generated on disappearance of the bubbles, to improve durability of the heater so as to easily obtain a further high-definition image. As for the structure for having the bubbles communicate with the outside air in the above patents laid-open, there is a named structure for significantly reducing the shortest distance between the electrothermal converting element for generating the bubbles in the ink and a discharge port which is an opening for discharging the ink compared to the past.

The structure of the record head of this type will be described hereafter. It has an element substrate on which the electrothermal converting element for discharging the ink is provided and a flow path composition substrate (also referred to as an orifice substrate) joined with the element substrate to constitute a flow path of the ink. The flow path composition substrate has a plurality of nozzles through which the ink flows, a supply chamber for supplying the ink to each of the nozzles, and a plurality of discharge ports which are nozzle end openings for discharging the ink droplets. The nozzle is comprised of a bubbling chamber in which bubbles are generated by the electrothermal converting element and a supply path for supplying the ink to the bubbling chamber. The element substrate has the electrothermal converting element provided to be located in the bubbling chamber. The element substrate also has a supply orifice provided for supplying the ink to the supply chamber from the rear surface on the opposite side of the principal surface in contact with the flow path composition substrate. And the flow path composition substrate has the discharge ports provided at positions opposed to the electrothermal converting elements on the element substrate.

As for the record head constituted as above, the ink supplied from the supply orifice into the supply chamber is provided along each nozzle so as to be filled in the bubbling chamber. The ink filled in the bubbling chamber is caused to fly by the bubbles generated due to film boiling by the electrothermal converting element in the direction almost orthogonal to the principal surface of the element substrate so that it is discharged as the ink droplets from the discharge ports.

SUMMARY OF THE INVENTION

Incidentally, as for the record head described above, when discharging the ink, the flow of the ink filled in the bubbling chamber is divided into the discharge port side and the supply path side by the bubble growing in the bubbling chamber. At that time, a pressure due to bubbling of a fluid slips away to the supply path side, or a pressure loss occurs due to friction with an inner wall of the discharge port. This phenomenon causes adverse effects on discharge, and it tends to become conspicuous as a liquid droplet becomes smaller. To be more specific, as a discharge caliber is rendered smaller in order to make a small liquid droplet, resistance of a discharge port portion becomes extremely high so that a flow rate in the discharge port direction decreases and the flow rate in the flow path direction increases, resulting in reduced discharge speed of the ink droplet. It is possible to provide a second discharge port portion of which cross-sectional area vertical to the flow is larger than the discharge port and thereby lower the entire flow resistance in the discharge port direction so that bubbling grows with less pressure loss in the discharge port direction. Thus, it is feasible to curb the flow rate slipping away in the flow path direction and prevent the reduction in the discharge speed of the ink droplets.

Incidentally, it was found out that, if the second discharge port portion is provided as described above and flow path resistance on a downstream side (discharge port side) of a heating element is lowered, a refill becomes slower at a boundary between the first and second discharge port portions compared to the case of providing no second discharge port portion.

As a matter of course, if the volume of the second discharge port portion is reduced, the refill condition will change so as to be improved. However, the effect of reducing the flow path resistance on the downstream side (discharge port side) will be drastically reduced. Thus, the inventors hereof earnestly reviewed the structure of the second discharge port portion having secured the volume of the second discharge port portion as much as possible and alleviated the reduction in the refill so as to achieve the present invention.

Thus, in consideration of the above-mentioned problems in the actuality, an object of the present invention is to provide an ink jet record head having a nozzle shape capable of preventing reduction in refill speed while reducing the flow resistance in the discharge direction.

Another object of the present invention is to provide the ink jet record head in the nozzle shape capable of curbing the above-mentioned variations in the discharge volume due to thermal storage of the ink.

To attain the objects, the ink jet record head according to the present invention is the one having: a flow path composition substrate having a plurality of nozzles through which liquid flows, a supply chamber for supplying the liquid to each of the nozzles, and a plurality of discharge ports which are nozzle end openings for discharging a liquid droplet, the above described nozzle comprised of a bubbling chamber in which bubbles are generated by the discharge energy generating element for generating thermal energy for discharging the liquid droplet, the discharge port portions including the above described discharge ports and communicating between the above described discharge ports and the above described bubbling chamber, and a supply path for supplying the ink to the bubbling chamber; and an element substrate on which the above described discharge energy generating element is provided and joining the above described flow path composition substrate with a principal surface, and wherein: the above described discharge port portion has: a first discharge port portion including the above described discharge port and having a cross section approximately constant against a discharge axis; and a second discharge port portion contiguous to the first discharge port portion with an uneven portion and communicating with the above described bubbling chamber while having the cross section parallel with the principal surface of the above described element substrate and larger than the cross section of the first discharge port portion, and a distance of the uneven portion farthest from a supply direction of the above described second discharge port portion is shorter than the distance of the above described uneven portion in an arrangement direction of the above described discharge ports.

Thus, a pressure loss rarely occurs in the flow of the liquid to the discharge port, and the ink is well discharged toward the discharge port. Thus, it is possible, even if the discharge port at the end of the nozzle becomes smaller and the flow resistance in the discharge port direction becomes higher in the first discharge port portion, to curb reduction in the flow rate in the discharge port direction on discharging so as to prevent the reduction in discharge speed of the ink droplet. Furthermore, a position of the ink flowing into the second discharge port portion (in particular, a maximum flow speed position) is deviated to the ink supply side so that an ink flow distance on refilling is consequently shortened to improve a refill frequency. When the entire second discharge port portion is deviated to the ink supply side, the uneven portion between the first discharge port portion and second discharge port portion on the farther side from the ink supply chamber becomes less so as to have the effects of reducing meniscus clipping on refilling and enhance the refill frequency. It is because, as there is a problem that a meniscus of the ink gets caught in the uneven portion between the first discharge port portion and second discharge port portion on the farther side from the ink supply chamber on refilling and the refill time is thereby extended, the refill frequency is enhanced by reducing the above described uneven portion.

At that time, it is possible, by rendering the second discharge port portion as a symmetric figure and a balanced shape to a perpendicular line passing through the discharge ports and intersecting in the arrangement direction of the discharge ports, to stably discharge the liquid droplet in a direction almost orthogonal to the principal surface of the element substrate.

Furthermore, as for the cross section approximately parallel with the above described element substrate, that is, space volume of the second discharge port portion, the length in the direction parallel with the arrangement direction of the discharge ports (direction vertical to the longitudinal direction of the supply path) is larger than the length in the direction vertical to the arrangement direction of the discharge ports (direction parallel with the longitudinal direction of the supply path), and so the form of the second discharge port portion is not so much limited by the position of a side wall which is the end of the supply path of the bubbling chamber. Moreover, in order to reduce the flow resistance in the discharge port direction, the form of the supply path of the second discharge port portion in the longitudinal direction was changed not to be larger so that, as the height of the supply path on an immediate upstream side of the bubbling chamber does not increase, there is no danger of a pressure due to bubbling of the liquid slipping away to the supply path side and reducing discharge efficiency.

In the main portion of the ink jet record head, an opening face on the first discharge port portion side of the above described second discharge port portion intersecting a discharge axis is a similar figure to the opening face on the bubbling chamber side of the above described second discharge port portion and is also a sectional shape of smaller area than the opening face on the bubbling chamber side, and so the uneven portion between the first and second discharge port portions can be rendered smaller. Therefore, in the case where discharge is successively performed at a high frequency, the minute stagnant areas of the ink having almost no flow speed become smaller in the flow in the discharge port direction after the bubbling. Consequently, the thermal storage of the ink is held down on successive discharge operations by the electrothermal converting element so that there will be fewer variations in the volume of discharged liquid droplet.

Furthermore, if the opening face on the first discharge port portion side of the above described second discharge port portion intersecting the discharge axis and the opening face on the bubbling chamber side of the above described second discharge port portion are ellipses or ovals, the area of the four corners becomes smaller and the stagnant areas of the ink also become smaller compared to the case where the opening face on the discharge port side of the above described second discharge port portion is approximately in a rectangular shape so that there will be fewer variations in the volume of discharged liquid droplets. Moreover, if the opening face on the first discharge port portion side of the above described second discharge port portion is rendered as a shape inscribed in the above described discharge port portion at two points in a plan perspective view for viewing it from a vertical direction to the principal surface of the above described element substrate, the stagnant areas of the ink further become smaller and there will be still fewer variations in the volume of discharged liquid droplet.

Furthermore, in the main portion of the ink jet record head, as the opening face on the bubbling chamber side of the above described second discharge port portion intersecting the discharge axis is rendered as the ellipse or oval and the opening face on the first discharge port portion side of the above described second discharge port portion is rendered as a circle and inside the ellipse or oval which is the opening face on the bubbling chamber side of the above described second discharge port portion, the uneven portion between the first discharge port portion and second discharge port portion is less and is also a point symmetry in reference to the center of the discharge port, so that the stagnant areas of the ink will not be deviated. Therefore, unstable discharge due to deviated stagnant areas can be resolved.

Furthermore, in the main portion of the ink jet record head, as the opening face on the first discharge port portion side of the above described second discharge port portion intersecting the discharge axis is rendered as a circle congruent with the opening face on the above described bubbling chamber side of the above described first discharge port portion, there will be almost no uneven portion between the first discharge port portion and the second discharge port portion. Therefore, there will not be minute stagnant areas of the ink having almost no flow speed in the flow in the discharge port direction after the bubbling. Consequently, there will be no thermal storage of the ink on the successive discharge operations at the high frequency by the electrothermal converting element so as to have very few variations in the volume of discharged liquid droplet.

DETAILED DESCRIPTION OF THE PREFERRED EMBODIMENTS

Figure 1:
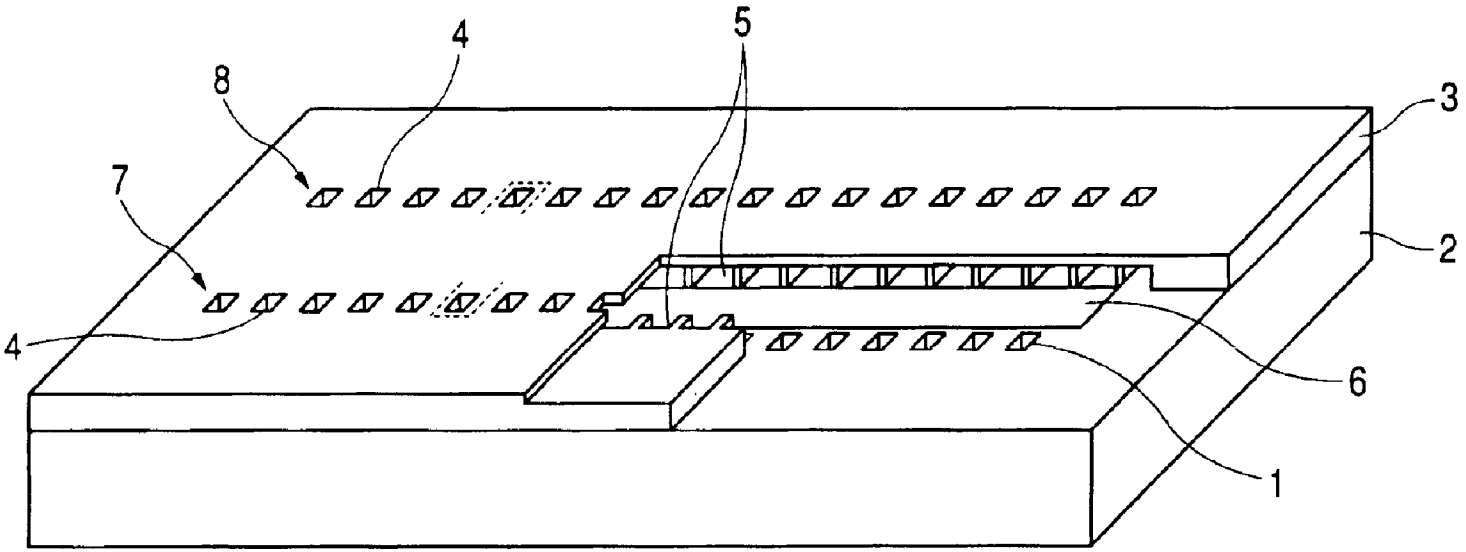
FIG. 1 is a perspective view showing a cutout portion of an embodiment of an ink jet record head suitable for the present invention.

Hereafter, the embodiments of the present invention will be described by referring to the drawings.

An ink jet record head according to the present invention is a record head specifically adopting a mode, of the ink jet recording systems, having means for generating thermal energy as energy utilized for discharging liquid ink and causing a status change of the ink with the thermal energy. It attains higher density and higher definition of characters and images to be recorded. In particular, according to the present invention, an electrothermal converting element is used as means for generating the thermal energy, and the ink is discharged by utilizing a pressure due to bubbles generated when heating and film-boiling the ink with the electrothermal converting element.

First, an overall structure of the ink jet record head according to this embodiment will be described.

FIG. 1 is a perspective view showing a cutout portion of the embodiment of the ink jet record head suitable for the present invention.

The ink jet record head in the form shown in FIG. 1 has a structure wherein an isolation wall is extendedly placed from a discharge port 4 to the proximity of a supply chamber 6 for the sake of individually and independently forming a nozzle 5 which is a flow path of the ink to each of a plurality of heaters 1 which are the electrothermal converting elements.

The ink jet record head has the plurality of heaters 2 and a plurality of nozzles 5, and is equipped with a first nozzle array 7 having the nozzles 5 in a longitudinal direction arranged in parallel and a second nozzle array 8 having the nozzles 5 in the longitudinal direction arranged in parallel at positions opposed to the first nozzle array 7 across the supply chamber 6.

The first and second nozzle arrays 7 and 8 are formed to have adjacent nozzles at intervals of a 600 dpi pitch. The nozzles 5 in the second nozzle array 8 are arranged so that the pitches among the adjacent nozzles are mutually deviated by a ½ pitch against the nozzles 5 in the first nozzle array 7.

The above-mentioned record head has an ink discharge means to which the ink jet recording system disclosed in Japanese Patent Application Laid-Open No. 4-10940 and Japanese Patent Application Laid-Open No. 4-10941 is applied, where bubbles generated when discharging the ink communicate with the outside air via the discharge port.

Hereafter, the nozzle structure of the ink jet record head which is a main part of the present invention will be described by taking various form examples.

(First Embodiment)

Figure 2A:
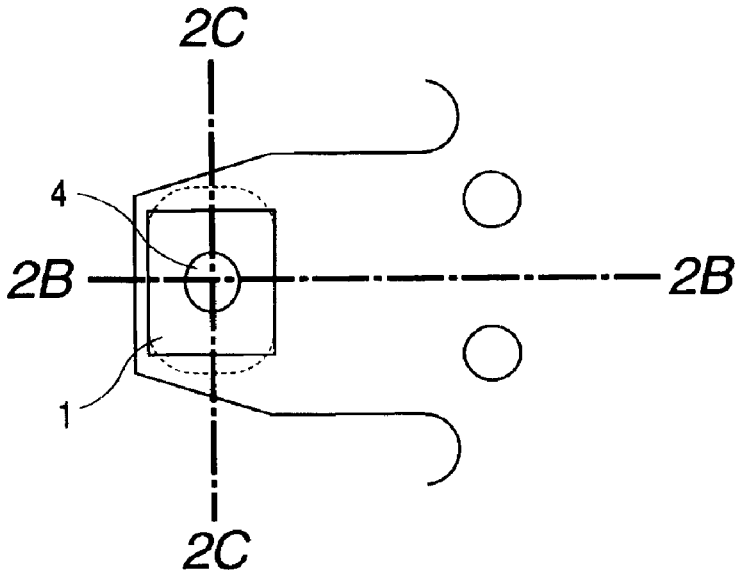
FIGS. 2A, 2B and 2C are diagrams for describing a nozzle structure of the ink jet record head according to a first embodiment of the present invention.
Figure 2B:
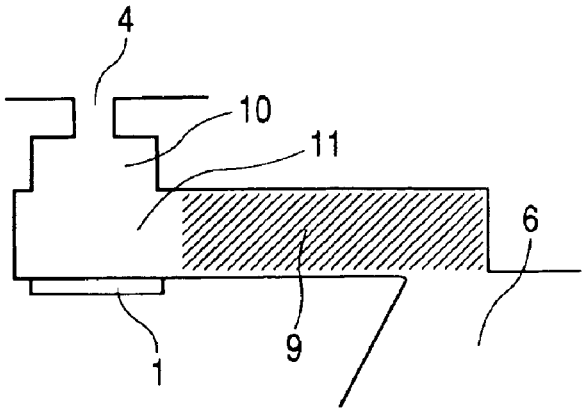
Figure 2C:
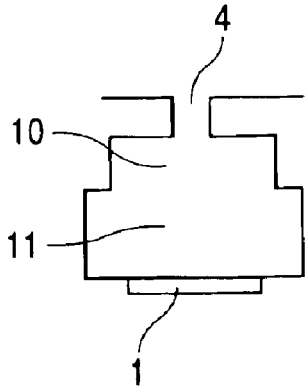

FIGS. 2A, 2B and 2C show the nozzle structure of the ink jet record head according to a first embodiment of the present invention. FIG. 2A is a plan perspective view for viewing one of the plurality of nozzles of the ink jet record head from a vertical direction to a substrate, FIG. 2B is a sectional view along a line 2B—2B in FIG. 2A, and FIG. 2C is a sectional view along a line 2C—2C in FIG. 2A.

As shown in FIG. 1, the record head having the nozzle structure in this form is equipped with an element substrate 2 on which the plurality of heaters 1 which are the electrothermal converting elements are provided and a flow path composition substrate 3 stacked on and joined with a principal surface of the element substrate 2 to constitute a plurality of flow paths of the ink.

The element substrate 2 is formed by glass, ceramics, resin, metal and so on for instance, and is generally formed by Si. On the principal surface of the element substrate 2, the heater 1, an electrode (not shown) for applying a voltage to the heater 1, and wiring (not shown) connected to the electrode are provided in each flow path of the ink in a predetermined wiring pattern respectively. Also on the principal surface of the element substrate 2, a insulated film (not shown) for improving emanation of thermal storage is provided as if to cover the heaters 1. Moreover, on the principal surface of the element substrate 2, a protective film (not shown) for protecting it from cavitation generated when the bubbles disappear is provided as if to cover the insulated film.

As shown in FIG. 1, the flow path composition substrate 3 has the plurality of nozzles 5 through which the ink flows, supply chamber 6 for supplying the ink to each of the nozzles 5 and the plurality of discharge ports 4 which are end openings of the nozzles 5 for discharging the ink droplets. The discharge ports 4 are formed at positions opposed to the heaters 1 on the element substrate 2. As shown in FIG. 2, the nozzle 5 has a first discharge port portion including the discharge port 4 and having an approximately constant diameter, a second discharge port portion 10 for reducing flow resistance on a discharge port side of the heater, a bubbling chamber 11 and a supply path 9 (shaded area in the drawing). The bubbling chamber 11 has a bottom face opposed to an opening face of the discharge port 4 approximately forming a rectangle formed on the heater 1. The supply path 9 has one end thereof communicating with the bubbling chamber 11 and the other end thereof communicating with the supply chamber 6, where a width of the supply path 9 is straightly formed to be almost equal from the supply chamber 6 to the bubbling chamber 11. The second discharge port portion 10 is successively formed on the bubbling chamber 11. Furthermore, the nozzle 5 is formed by orthogonalizing a discharge direction in which the ink droplets fly from the discharge port 4 and a flow direction of the ink liquid flowing in the supply path 9.

The nozzle 5 shown in FIG. 1 comprised of the first discharge port portion including the discharge port 4, second discharge port portion 10, bubbling chamber 11 and supply path 9 has inner wall surfaces opposed to the principal surface of the element substrate 2 formed from the supply chamber 6 to the bubbling chamber 11 in parallel with the principal surface of the element substrate 2 respectively.

As shown in a plan perspective view in FIG. 2A, as for the opening face on the bubbling chamber 11 side of the second discharge port portion 10, the length in the direction parallel with the arrangement direction of the discharge ports 4 is larger than the length in the direction vertical to the arrangement direction thereof. The opening face on the first discharge port portion side is also a sectional shape congruent with the opening face on the bubbling chamber 11 side. In FIG. 2A, however, a cross section cut in a direction approximately parallel with the surface on which the heaters 1 are formed of the second discharge port portion 10 is shown.

To stably discharge the liquid droplets in a direction almost orthogonal to the surface on which the heaters 1 are formed (principal surface of the element substrate 2), the second discharge port portion 10 is rendered as a symmetric figure and a balanced shape to a perpendicular line passing through the discharge ports 4 and intersecting the arrangement direction of the discharge ports. On any cross section going through the center of the discharge port 4 and vertical to the principal surface of the above described element substrate, a side wall of the second discharge port portion 10 is represented by a straight line, and the opening face on the first discharge port portion side of the above described second discharge port portion 10, the opening face on the bubbling chamber 11 side thereof and the principal surface of the above described element substrate are parallel.

Furthermore, as for the cross section in the direction approximately parallel with the above described element substrate, that is, space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of a side wall which is the end of the supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on an immediate upstream side of the bubbling chamber 11 does not increase, there is no danger of a pressure due to bubbling of the liquid slipping away to the supply path side and reducing discharge efficiency.

Furthermore, it is possible, by shortening the length in the direction parallel with the arrangement direction of the discharge ports 4 which are the farthest from the ink supply direction (direction vertical to the longitudinal direction of the supply path 9), to improve a speed of filling the ink in the discharge port portions and increase a refilling speed while keeping flow path resistance on the discharge port side low.

Next, a description will be given based on FIGS. 1, 2A, 2B and 2C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by a growth pressure of the bubbles generated due to film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

Figure 8A:
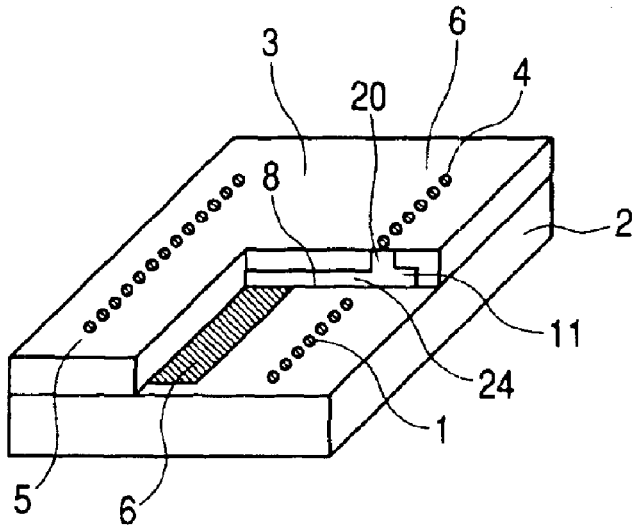
FIGS. 8A and 8B are perspective views showing a cutout portion of a seventh embodiment of an ink jet record head suitable for the present invention.
Figure 8B:
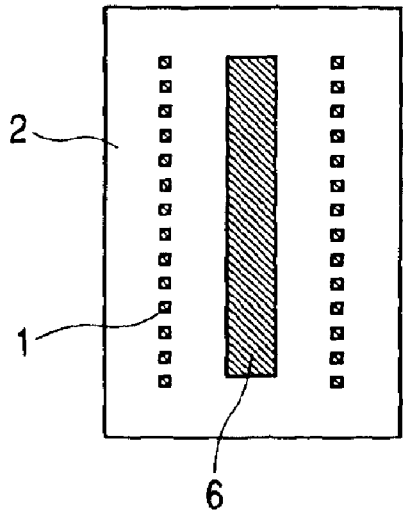

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the first embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the discharge port portion, to curb reduction in the flow rate in the discharge port direction on discharging so as to prevent the reduction in the discharge speed of the ink droplets.

(Second Embodiment)

This embodiment shows the nozzle structure considering the problem that, in the case of enlarging sectional area vertical to the flow of the second discharge port portion, stagnant areas of the ink are also enlarged and the heat due to an electrothermal converting element is stored in the head on successive discharge operations. Here, the differences from the first embodiment will be mainly described based on FIGS. 3A, 3B and 3C.

Figure 3A:
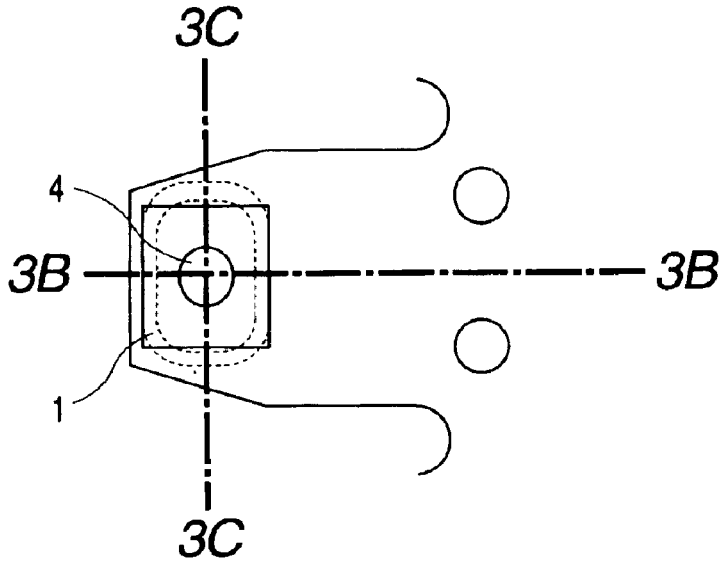
FIGS. 3A, 3B and 3C are diagrams for describing the nozzle structure of the ink jet record head according to a second embodiment of the present invention.
Figure 3B:
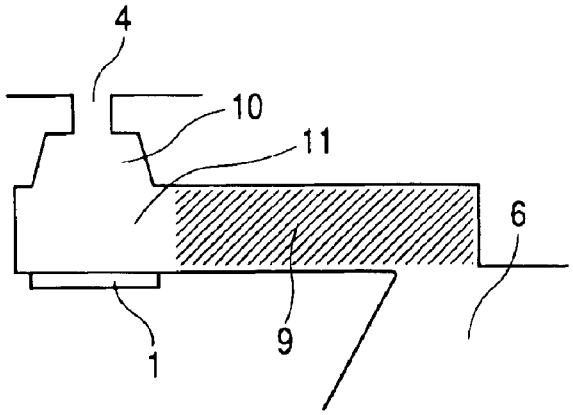
Figure 3C:
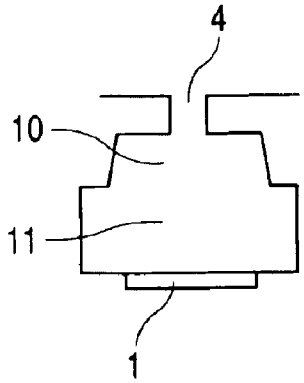

FIGS. 3A, 3B and 3C show the nozzle structure of the ink jet record head according to a second embodiment of the present invention. FIG. 3A is a plan perspective view for viewing one of the plurality of nozzles of the ink jet record head from the vertical direction to the substrate, FIG. 3B is a sectional view along a line 3B—3B in FIG. 3A, and FIG. 3C is a sectional view along a line 3C—3C in FIG. 3A.

As shown in a plan perspective view in FIG. 3A, as for the opening face on the bubbling chamber 11 side of the second discharge port portion 10, the length in the direction parallel with the arrangement direction of the discharge ports 4 is larger than the length in the direction vertical to the arrangement direction thereof. The opening face on the first discharge port portion side is a similar figure to the opening face on the bubbling chamber 11 side, and is a sectional shape of which area is smaller than that. In FIG. 2A, however, the cross section cut in the direction approximately parallel with the surface on which the heaters 1 are formed of the second discharge port portion 10 is shown.

To stably discharge the liquid droplets in the direction almost orthogonal to the surface on which the heaters 1 are formed (principal surface of the element substrate 2), the second discharge port portion 10 is rendered as a symmetric figure and a balanced shape to a perpendicular line passing through the discharge ports 4 and intersecting the arrangement direction of the discharge ports. On any cross section going through the center of the discharge port 4 and vertical to the principal surface of the above described element substrate, the side wall of the second discharge port portion 10 is represented by the straight line, and the opening face on the first discharge port portion side of the above described second discharge port portion 10, the opening face on the bubbling chamber 11 side thereof and the principal surface of the above described element substrate are parallel.

Furthermore, as for the cross section in the direction approximately parallel with the above described element substrate, that is, the space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of the side wall which is the end of the ink supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on the immediate upstream side of the bubbling chamber 11 does not increase, there is no danger of the pressure due to bubbling of the liquid slipping away to the supply path side and reducing discharge efficiency.

Next, a description will be given based on FIGS. 1, 3A, 3B and 3C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by a growth pressure of the bubbles generated due to film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the second embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

Here, it should be noted that, compared to the first embodiment, the cross section parallel with the principal surface of the element substrate 2 of the second discharge port portion 10 becomes smaller as it gets closer to the discharge port 4 side, and so there is a possibility that the flow resistance of the entire second discharge port portion 10 is high. However, the uneven portion between the first discharge port portion and second discharge port portion 10 is the stagnant portion in which a fluid does not flow in reality so that it is consequently maintained at the flow resistance equivalent to that of the first embodiment.

In the case of successively discharging at the high frequency, the stagnant area of the ink having almost no flow speed also becomes smaller in the flow in the discharge port direction after the bubbling because the uneven portion between the first discharge port portion and second discharge port portion 10 becomes smaller than that of the first embodiment. Consequently, the thermal storage of the ink is curbed on the successive discharge operations by the electrothermal converting element so that there will be fewer variations in the volume of discharged liquid droplets. In the case of successively discharging at the high frequency, the mechanism for having the variations in the volume of the discharged liquid droplets caused by stagnation of the ink in the nozzle is as described in the summary of the invention.

(Third Embodiment)

An object of a third embodiment is to render the stagnant areas of the ink smaller in order to reduce the variations in the discharge volume.

Figure 4A:
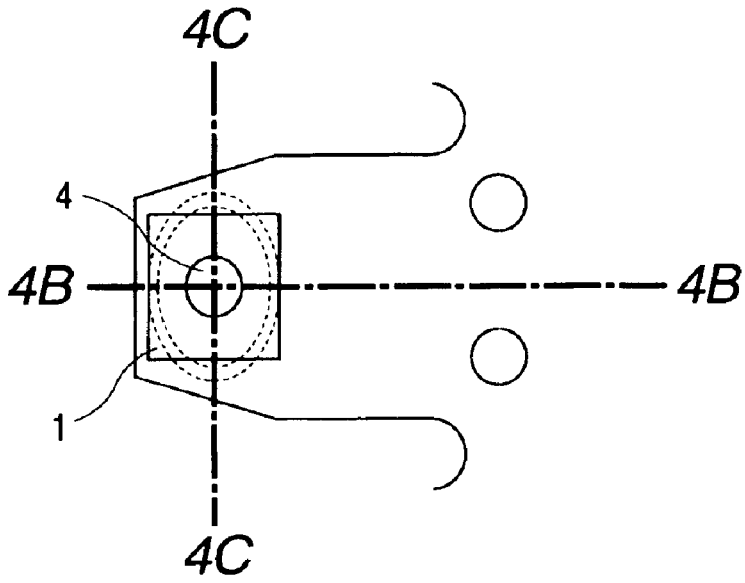
FIGS. 4A, 4B and 4C are diagrams for describing the nozzle structure of the ink jet record head according to a third embodiment of the present invention.
Figure 4B:
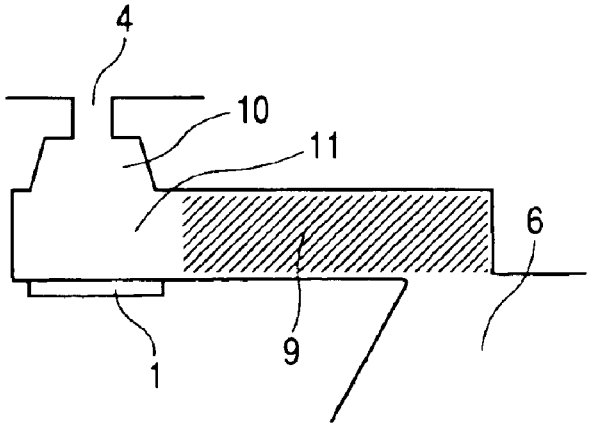
Figure 4C:
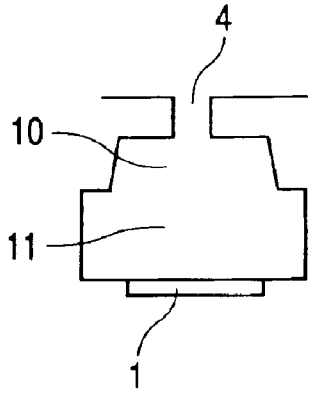

Here, as for the third embodiment, the differences from the first embodiment will be mainly described based on FIGS. 4A, 4B and 4C.

FIGS. 4A, 4B and 4C show the nozzle structure of the ink jet record head according to the third embodiment of the present invention. FIG. 4A is a plan perspective view for viewing one of the plurality of nozzles of the ink jet record head from the vertical direction to the substrate, FIG. 4B is a sectional view along a line 4B—4B in FIG. 4A, and FIG. 4C is a sectional view along a line 4C—4C in FIG. 4A.

As shown in the plan perspective view in FIG. 4A, the opening face on the bubbling chamber 11 side of the second discharge port portion 10 is the ellipse or oval wherein the diameter in the direction parallel with the arrangement direction of the discharge ports 4 is larger than the diameter in the direction vertical to the arrangement direction thereof. The opening face on the first discharge port portion side is the similar figure to the opening face on the bubbling chamber 11 side, and is the sectional shape of which area is smaller than the opening face on the bubbling chamber 11 side. Thus, it is possible, by rendering as the ellipse or oval the cross section cut in the direction approximately parallel with the surface on which the heaters 1 are formed of the second discharge port portion 10, to eliminate the stagnant areas in the four corners generated when the cross section is approximately rectangular.

To stably discharge the liquid droplets in a direction almost orthogonal to the surface on which the heaters 1 are formed (principal surface of the element substrate 2), the second discharge port portion 10 is rendered as the symmetric figure and balanced shape to a perpendicular line passing through the discharge ports 4 and intersecting the arrangement direction of the discharge ports. On any cross section going through the center of the discharge port 4 and vertical to the principal surface of the above described element substrate, the side wall of the second discharge port portion 10 is represented by the straight line, and the opening face on the first discharge port portion side of the above described second discharge port portion 10, the opening face on the bubbling chamber 11 side thereof and the principal surface of the above described element substrate are parallel.

Furthermore, as for the cross section in the direction approximately parallel with the above described element substrate, that is, the space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of the side wall which is the end of the supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on the immediate upstream side of the bubbling chamber 11 does not increase, there is no danger of the pressure due to the bubbling of the liquid slipping away to the supply path side and reducing the discharge efficiency.

Next, a description will be given based on FIGS. 1, 4A, 4B and 4C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the third embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

Here, it should be noted that, compared to the second embodiment, the cross section parallel with the principal surface of the element substrate 2 of the second discharge port portion 10 is rendered as the ellipse or oval, and so the area in the four corners is reduced and there is a possibility that the flow resistance of the entire second discharge port portion 10 becomes higher. However, the area in the four corners is the stagnant portion in which the fluid does not flow in reality so that it is consequently maintained at the flow resistance equivalent to that of the second embodiment.

In the case of successively discharging at the high frequency, compared to the second embodiment, the area of the four corners becomes smaller and the stagnant areas of the ink also become smaller as to the cross section parallel with the principal surface of the element substrate 2 of the second discharge port portion 10 so that there will be fewer variations in the volume of the discharged liquid droplets.

(Fourth Embodiment)

An object of a fourth embodiment is to render the stagnant areas of the ink smaller in order to reduce the variations in the discharge volume.

Figure 5A:
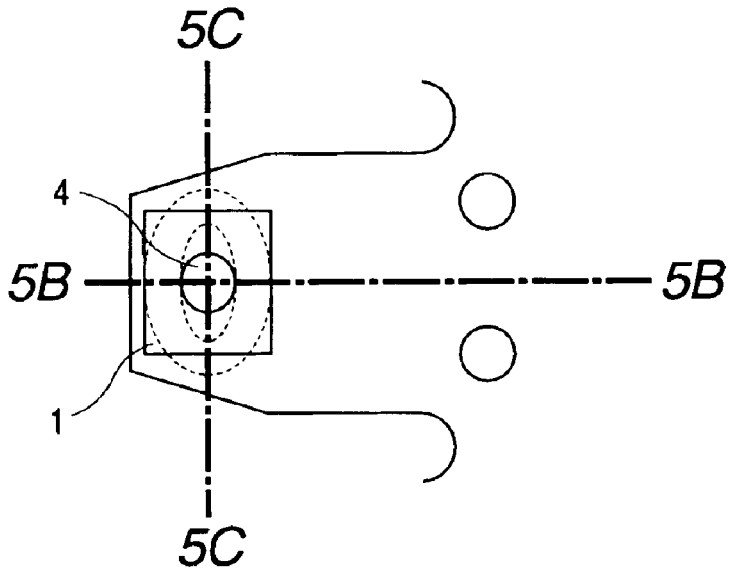
FIGS. 5A, 5B and 5C are diagrams for describing the nozzle structure of the ink jet record head according to a fourth embodiment of the present invention.
Figure 5B:
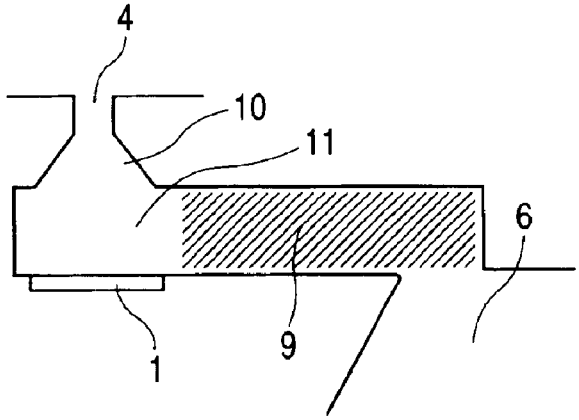
Figure 5C:
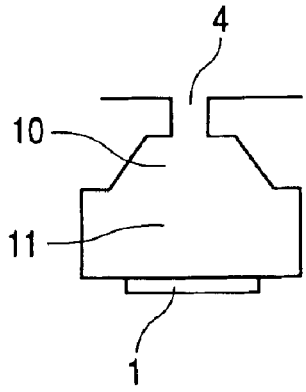

Here, as for the fourth embodiment, the differences from the first embodiment will be mainly described based on FIGS. 5A, 5B and 5C.

FIGS. 5A, 5B and 5C show the nozzle structure of the ink jet record head according to the fourth embodiment of the present invention. FIG. 5A is a plan perspective view for viewing one of the plurality of nozzles of the ink jet record head from the vertical direction to the substrate, FIG. 5B is a sectional view along a line 5B—5B in FIG. 5A, and FIG. 5C is a sectional view along a line 5C—5C in FIG. 5A.

As shown in the plan perspective view in FIG. 5A, the opening face on the bubbling chamber 11 side of the second discharge port portion 10 is the ellipse or oval wherein the diameter in the direction parallel with the arrangement direction of the discharge ports 4 is larger than the diameter in the direction vertical to the arrangement direction thereof. The opening face on the first discharge port portion side is the similar figure to the opening face on the bubbling chamber 11 side, and is inscribed in the discharge port sections at two points. As for such a shape, the uneven portion between the first discharge port portion and second discharge port portion 10 becomes smaller than that of the third embodiment so that the stagnant areas of the ink are reduced.

To stably discharge the liquid droplets in the direction almost orthogonal to the surface on which the heaters 1 are formed (principal surface of the element substrate 2), the second discharge port portion 10 is rendered as the symmetric figure and balanced shape to the perpendicular line passing through the discharge ports 4 and intersecting the arrangement direction of the discharge ports. On any cross section going through the center of the discharge port 4 and vertical to the principal surface of the above described element substrate, the side wall of the second discharge port portion 10 is represented by the straight line, and the opening face on the first discharge port portion side of the second discharge port portion 10, the opening face on the bubbling chamber 11 side thereof and the principal surface of the above described element substrate are parallel.

Furthermore, as for the cross section in the direction approximately parallel with the above described element substrate, that is, the space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of the side wall which is the end of the supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on the immediate upstream side of the bubbling chamber 11 does not increase, there is no danger of the pressure due to the bubbling of the liquid slipping away to the supply path side and reducing the discharge efficiency.

Next, a description will be given based on FIGS. 1, 5A, 5B and 5C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the fourth embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

Here, it should be noted that, compared to the third embodiment, the cross section parallel with the principal surface of the element substrate 2 of the second discharge port portion 10 becomes smaller, and so there is a possibility that the flow resistance of the entire second discharge port portion 10 becomes higher. However, the uneven portion between the first discharge port portion and second discharge port portion 10 is the stagnant portion in which a fluid does not flow in reality so that it is consequently maintained at the flow resistance equivalent to that of the third embodiment.

In the case of successively discharging at the high frequency, compared to the third embodiment, the uneven portion between the first discharge port portion and the second discharge port portion 10 becomes smaller and the stagnant areas of the ink are reduced so that there will be fewer variations in the volume of the discharged liquid droplets.

(Fifth Embodiment)

An object of a fifth embodiment is to render the stagnant areas of the ink smaller in order to reduce the variations in the discharge volume. Another object of the fifth embodiment is to form the uneven portion between the second discharge port portion and the first discharge port portion as a point symmetry (to be a donut shape) so as to resolve unstable discharge due to a deviation of the stagnant areas generated therein.

Figure 6A:
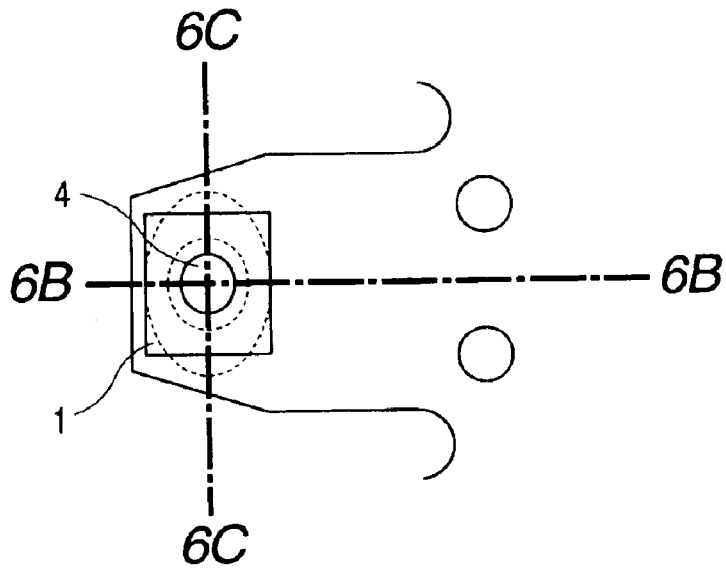
FIGS. 6A, 6B and 6C are diagrams for describing a nozzle structure of the ink jet record head according to a fifth embodiment of the present invention.
Figure 6B:
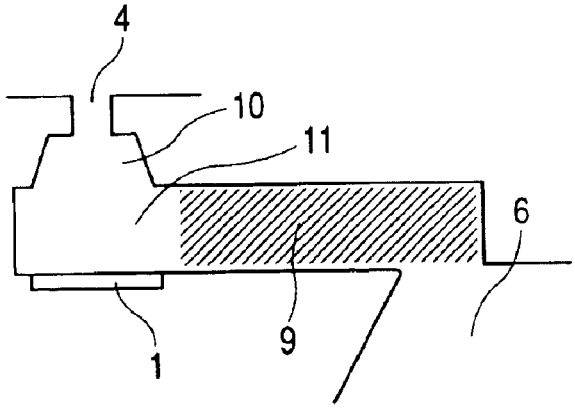
Figure 6C:
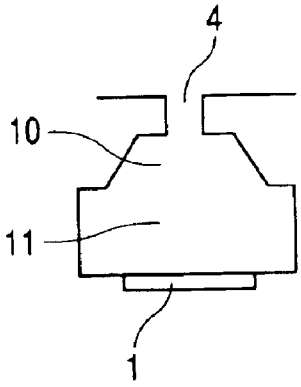

Here, as for the fifth embodiment, the differences from the first embodiment will be mainly described based on FIGS. 6A, 6B and 6C.

FIGS. 6A, 6B and 6C show the nozzle structure of the ink jet record head according to the fifth embodiment of the present invention. FIG. 6A is a plan perspective view for viewing one of the plurality of nozzles of the ink jet record head from the vertical direction to the substrate, FIG. 6B is a sectional view along a line 6B—6B in FIG. 6A, and FIG. 6C is a sectional view along a line 6C—6C in FIG. 6A.

As shown in the plan perspective view in FIG. 6A, the opening face on the bubbling chamber 11 side of the second discharge port portion 10 is the ellipse or oval wherein the diameter in the direction parallel with the arrangement direction of the discharge ports 4 is larger than the diameter in the direction vertical to the arrangement direction thereof. The opening face on the first discharge port portion side is a circle and is inside the opening face on the bubbling chamber 11 side. As for such a shape, the uneven portion between the second discharge port portion 10 and first discharge port portion is formed to be the point symmetry to the perpendicular line drawn down from the center of the discharge port 4 to the principal surface of the above described element substrate, and so there is no danger of causing the unstable discharge due to the deviation of the stagnant areas.

To stably discharge the liquid droplets in the direction almost orthogonal to the surface on which the heaters 1 are formed (principal surface of the element substrate 2), the second discharge port portion 10 is rendered as the symmetric figure and balanced shape to the perpendicular line passing through the discharge ports 4 and intersecting the arrangement direction of the discharge ports. On any cross section going through the center of the discharge port 4 and vertical to the principal surface of the above described element substrate, the side wall of the second discharge port portion 10 is represented by the straight line, and the opening face on the first discharge port portion side of the second discharge port portion 10, the opening face on the bubbling chamber 11 side thereof and the principal surface of the above described element substrate are parallel.

Furthermore, as for the cross section in the direction approximately parallel with the above described element substrate, that is, the space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of the side wall which is the end of the supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on the immediate upstream side of the bubbling chamber 11 does not increase, there is no danger of the pressure due to the bubbling of the liquid slipping away to the supply path side and reducing the discharge efficiency.

Next, a description will be given based on FIGS. 1, 6A, 6B and 6C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the fifth embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the first discharge port portion, to curb the reduction in the flow rate in the discharge port direction on discharging so as to prevent the reduction in the discharge speed of the ink droplets.

Here, it should be noted that, compared to the first embodiment, the cross section parallel with the principal surface of the element substrate of the second discharge port portion 10 becomes smaller, and so there is a possibility that the entire flow resistance of the second discharge port portion becomes higher. However, the uneven portion between the first discharge port portion and second discharge port portion is the stagnant portion in which the fluid does not flow in reality so that it is consequently maintained at the flow resistance equivalent to that of the first embodiment.

Furthermore, compared to the above-mentioned embodiments, the uneven portion between the second discharge port portion 10 and the first discharge port portion is formed as the point symmetry so that the stagnant portion of the ink is not deviated in the entire uneven portion, resulting in stable discharge characteristics.

(Sixth Embodiment)

An object of a sixth embodiment is to render the stagnant areas of the ink smaller in order to reduce the variations in the volume of the discharged liquid droplets. Another object of the sixth embodiment is to mostly eliminate the uneven portion between the second discharge port portion and the first discharge port portion so as to resolve the unstable discharge due to the deviation of the stagnant areas.

Figure 7A:
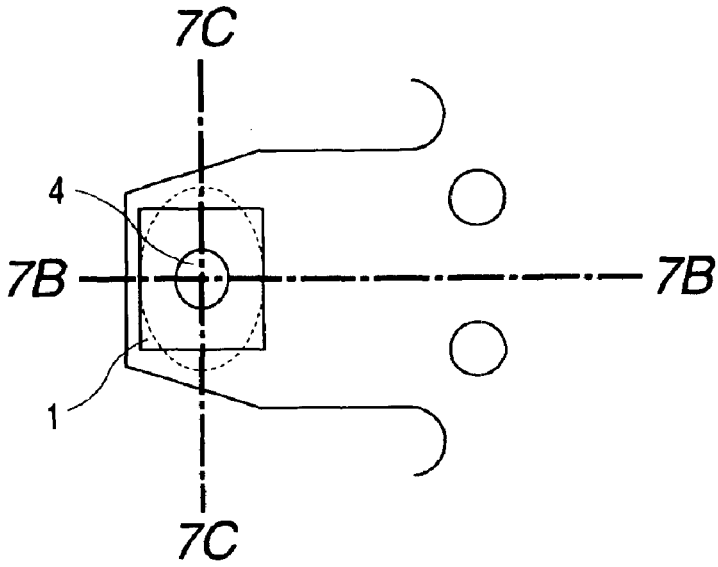
FIGS. 7A, 7B and 7C are diagrams for describing a nozzle structure of the ink jet record head according to a sixth embodiment of the present invention.
Figure 7B:
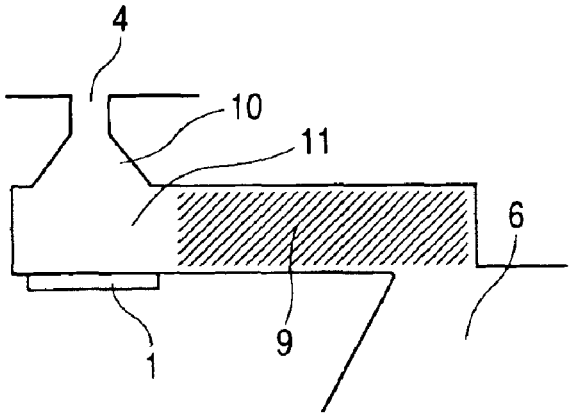
Figure 7C:
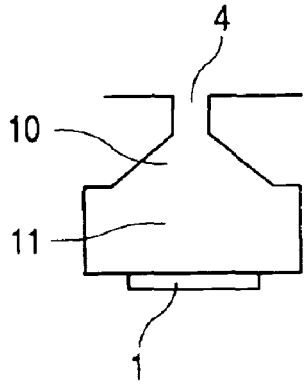

Here, as for the sixth embodiment, the differences from the first embodiment will be mainly described based on FIGS. 7A, 7B and 7C.

FIGS. 7A, 7B and 7C show the nozzle structure of the ink jet record head according to the sixth embodiment of the present invention. FIG. 7A is a plan perspective view for viewing one of the plurality of nozzles of the ink jet record head from the vertical direction to the substrate, FIG. 7B is a sectional view along a line 7B—7B in FIG. 7A, and FIG. 7C is a sectional view along a line 7C—7C in FIG. 7A.

As shown in the plan perspective view in FIG. 7A, the opening face on the bubbling chamber 11 side of the second discharge port portion 10 is the ellipse or oval wherein the diameter in the direction parallel with the arrangement direction of the discharge ports 4 is larger than the diameter in the direction vertical to the arrangement direction thereof. The opening face on the first discharge port portion side is a circle which is congruent with the opening face on the second discharge port portion 10 side of the discharge port portion. As for such a shape, there is almost no uneven portion between the second discharge port portion 10 and the first discharge port portion so that there will be no stagnant area of the ink between the second discharge port portion and the first discharge port portion.

To stably discharge the liquid droplets in the direction almost orthogonal to the surface on which the heaters 1 are formed (principal surface of the element substrate 2), the second discharge port portion 10 is rendered as the symmetric figure and balanced shape to the perpendicular line passing through the discharge ports 4 and intersecting the arrangement direction of the discharge ports. On any cross section going through the center of the discharge port 4 and vertical to the principal surface of the above described element substrate, the side wall of the second discharge port portion 10 is represented by the straight line, and the opening face on the first discharge port portion side of the second discharge port portion 10, the opening face on the bubbling chamber 11 side thereof and the principal surface of the above described element substrate are parallel.

Furthermore, as for the cross section in the direction approximately parallel with the above described element substrate, that is, the space volume of the second discharge port portion 10, the length in the direction parallel with the arrangement direction of the discharge ports 4 which are the farthest from the ink supply direction (direction vertical to the longitudinal direction of the supply path 9) is larger than the length in the direction vertical to the arrangement direction of the discharge ports 4 (direction parallel with the longitudinal direction of the supply path 9), and so the form of the second discharge port portion 10 is not so much limited by the position of the side wall which is the end of the supply path 9 of the bubbling chamber 11. Moreover, in order to reduce the flow resistance in the discharge port direction, the form of the supply path 9 of the second discharge port portion 10 in the longitudinal direction was changed not to be larger so that, as the height of the supply path 9 on the immediate upstream side of the bubbling chamber 11 does not increase, there is no danger of the pressure due to the bubbling of the liquid slipping away to the supply path side and reducing the discharge efficiency.

Next, a description will be given based on FIGS. 1, 7A, 7B and 7C as to the operation of discharging the ink droplets from the discharge port 4 on the record head constituted as above.

First, the ink supplied to the inside of the supply chamber 6 is supplied to the nozzles 5 of the first nozzle array 7 and second nozzle array 8 respectively. The ink supplied to each nozzle 5 flows along the supply path 9 so as to be filled in the bubbling chamber 11. The ink filled in the bubbling chamber 11 is caused to fly by the growth pressure of the bubbles generated due to the film boiling by the heater 1 in the direction almost orthogonal to the principal surface of the element substrate 2 so that it is discharged as the ink droplets from the discharge port 4. When the ink filled in the bubbling chamber 11 is discharged, a part of it flows to the supply path 9 side due to the pressure of the bubbles generated in the bubbling chamber 11. Here, if the aspect from the bubbling to the discharge of the nozzle is locally viewed, the pressure of the bubbles generated in the bubbling chamber 11 is immediately conveyed to the second discharge port portion 10, and the ink filled in the bubbling chamber 11 and second discharge port portion 10 moves inside the second discharge port portion 10.

In this case, compared to the record head in FIGS. 8A and 8B of which second discharge port portion 10 in the nozzle is cylindrical, the cross section parallel with the principal surface of the element substrate 2, that is, the space volume of the second discharge port portion 10 is larger according to the sixth embodiment, and so the pressure loss rarely occurs and the ink is well discharged toward the discharge port 4. Thus, it is possible, even if the discharge port at the end of the nozzle becomes smaller and the flow resistance in the discharge port direction becomes higher in the discharge port portion, to curb the reduction in the flow rate in the discharge port direction on discharging so as to prevent the reduction in the discharge speed of the ink droplets.

(Seventh Embodiment)

FIGS. 9A, 9B, 10A, 10B, 11A, 11B, 12A and 12B show the nozzle structure of the ink jet record head according to the seventh embodiment of the present invention. FIGS. 9A, 10A, 11A and 12A are plan perspective views for viewing one of the plurality of nozzles of the ink jet record head from the vertical direction to the substrate, and FIGS. 9B, 10B, 11B and 12B are sectional views along lines 9B—9B, 10B—10B, 11B—11B and 12B—12B in FIGS. 9A, 10A, 11A and 12A, respectively.

As shown in FIGS. 8A and 8B, the record head having the nozzle structure according to this embodiment is equipped with the element substrate 2 on which the electrothermal converting elements 1 are provided and a flow path composition substrate 3 stacked on and joined with a principal surface of the element substrate 2 to constitute a plurality of flow paths of the ink.

The element substrate 2 is formed by glass, ceramics, resin, metal and so on for instance, and is generally formed by Si. On the principal surface of the element substrate 2, the heater 1, an electrode (not shown) for applying a voltage to the heater 1, and wiring (not shown) connected to the electrode are provided in each flow path of the ink in a predetermined wiring pattern respectively. Also, on the principal surface of the element substrate 2, a dielectric film (not shown) for improving emanation of the thermal storage is provided as if to cover the electrothermal converting elements 1. Moreover, on the principal surface of the element substrate 2, a protective film (not shown) for protecting it from cavitation generated when the bubbles disappear is provided as if to cover the insulated film.

As shown in FIGS. 8A and 8B, the flow path composition substrate 3 has a plurality of nozzles 24 through which the ink flows, and each of the nozzles 24 has the supply chamber 6 and supply path 20 for supplying the ink, the bubbling chamber 11 for boiling the ink and generating the bubbles and a discharge port portion 20 which is an end opening of the nozzle 24 for discharging the ink droplets. The discharge port portion 20 is formed at the position opposed to the electrothermal converting elements 1 on the element substrate 2.

The nozzle form is formed so that an axis going through a center of gravity of a discharge port portion bottom surface 13 and vertically intersecting the principal surface of the element substrate (hereafter, a discharge port portion second axis 14) is deviated to the ink supply chamber side against the axis going through the center of gravity of a discharge port portion top surface 21 and vertically intersecting the principal surface of the element substrate 2 (hereafter, a discharge port portion first axis 12) in the plan perspective views for viewing it from the vertical direction to the principal surface of the above described substrate, and the axis going through the center of gravity of the electrothermal converting element 1 and vertically intersecting the principal surface of the element substrate (hereafter, a heater axis 15) matches with the above described discharge port portion first axis 12.

There are the following advantages in deviating the discharge port portion first axis 12 and discharge port portion second axis 14 as described above and placing the discharge port portion first axis 12 to match with the heater axis 15. Matching the discharge port portion first axis 12 with the heater axis 15 has the effects that bubbling pressure generated by the electrothermal converting elements 1 and an ink flow generated by the bubbling pressure become even against the discharge port portion first axis 12 so as to prevent kinks of the discharged ink droplets and their satellite droplets and enhance their landing accuracy. Placing the discharge port portion second axis closer to the ink supply chamber side compared to the discharge port portion first axis has the effect of shortening an ink flow distance and enhancing a refill frequency. Furthermore, in the case where the discharge port portion 20 is formed by a first discharge port portion 16 and the second discharge port portion 10, an ink flow position leaves an uneven portion 18 between the first discharge port portion 16 and second discharge port portion 10 on the opposite side of the ink supply chamber 6 so as to reduce clipping on refilling at the uneven portion 18 and thereby enhance the refill frequency.

Hereafter, as for the seventh embodiment wherein the discharge port portion second axis 14 is deviated to the ink supply chamber side against the discharge port portion first axis 12 and the discharge port portion first axis 12 matches with the heater axis 15, several concrete examples will be described by referring to the effects produced by the differences in the form of the discharge port portion 20. Reference numeral 33 denotes a supply orifice and 35 denotes a taper portion in the drawings.

(Embodiment 7-1)

Figure 9A:
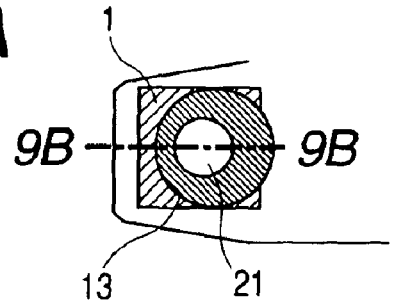
FIGS. 9A and 9B are first schematic diagrams of a nozzle structure of the ink jet record head according to a seventh embodiment of the present invention.
Figure 9B:
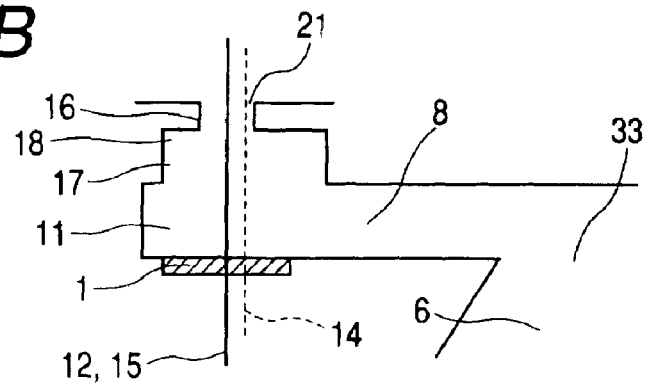

As for the nozzle form shown in FIGS. 9A and 9B, the discharge port portion 20 is formed by the first discharge port portion 16 and second discharge port portion 10 in increasing order of distance from a discharge port 11, and the sectional area in the plan perspective view for viewing it from the vertical direction to the principal surface of the element substrate 2 is formed to be larger in the second discharge port portion 10 than in the first discharge port portion 16.

It is possible, by rendering it in such a form, to reduce the flow resistance of the discharge port portion 20 so as to enhance printing quality without reducing the discharge speed even if discharge droplets are rendered smaller. Here, the cross section vertical to the flows in the first discharge port portion 16 and second discharge port portion 10 is not limited to the circle but may also be an ellipse, an oval, a polygon or a nearly circular figure surrounded by a curve.

(Embodiment 7-2)

Figure 10A:
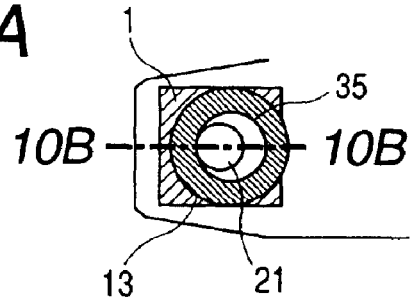
FIGS. 10A and 10B are second schematic diagrams of a nozzle structure of the ink jet record head according to a seventh embodiment of the present invention.
Figure 10B:
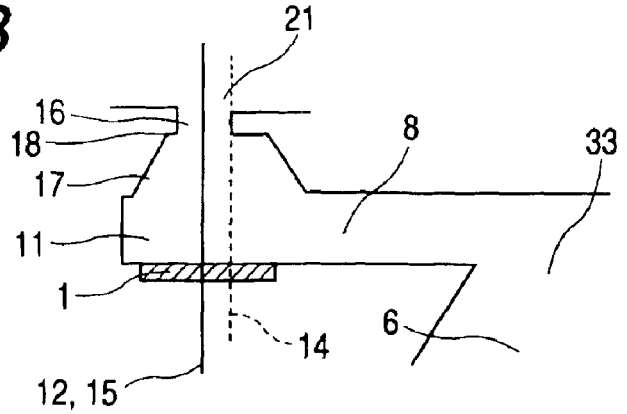

The nozzle form shown in FIGS. 10A and 10B is one of the variations of the (Embodiment 7-1). As for the nozzle form shown in FIGS. 10A and 10B, the first discharge port portion 16 is cylindrical and the second discharge port portion 10 is shaped like a truncated cone. It is possible, by shaping the second discharge port portion 10 like a truncated cone, to further reduce the flow resistance compared to the (Embodiment 7-1). Moreover, the uneven portion 18 between the first discharge port portion 16 and second discharge port portion 10 is reduced, and so the stagnant areas of the ink stagnating in the uneven portion 18 become less so that discharge amount, discharge speed and so on become stable and the printing quality is improved. It is because the ink stagnating in the uneven portion 18 is at a temperature higher than the surrounding ink due to the influence of being warmed by the electrothermal converting elements so that it changes viscosity resistance of the discharged ink and has negative effects on the discharge characteristics. Here, the cross section vertical to the flows in the first discharge port portion 16 and second discharge port portion 10 is not limited to the circle but may also be the ellipse, oval, polygon or nearly circular figure surrounded by the curve.

(Embodiment 7-3)

Figure 11A:
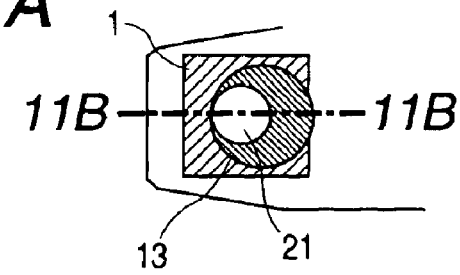
FIGS. 11A and 11B are third schematic diagrams of a nozzle structure of the ink jet record head according to a seventh embodiment of the present invention.
Figure 11B:
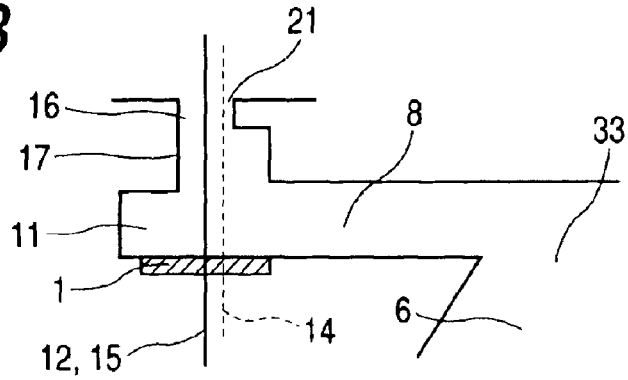

As for the nozzle form shown in FIGS. 11A and 11B, both the first discharge port portion 16 and second discharge port portion 10 are cylindrical, which is the same combination as the embodiment in FIGS. 9A and 9B. However, it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. Thus, compared to the (Embodiment 7-1), it has the effect of enhancing the refill frequency by reducing the clipping of the ink in the uneven portion 18. Here, the cross section vertical to the flows in the first discharge port portion 16 and second discharge port portion 10 is not limited to the circle but may also be the ellipse, oval, polygon or nearly circular figure surrounded by the curve.

(Embodiment 7-4)

Figure 12A:
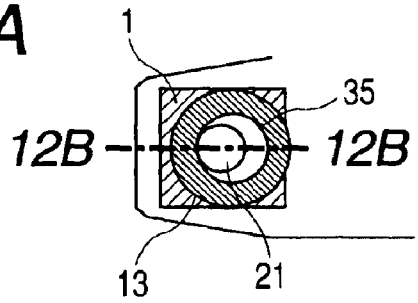
FIGS. 12A and 12B are fourth schematic diagrams of a nozzle structure of the ink jet record head according to a seventh embodiment of the present invention.
Figure 12B:
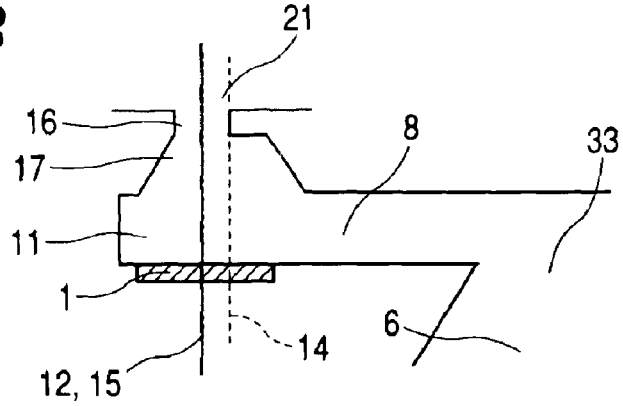

As for the nozzle form shown in FIGS. 12A and 12B, the first discharge port portion 16 is cylindrical and the second discharge port portion 10 is shaped like a truncated cone, and it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. If the second discharge port portion 10 is shaped like a truncated cone as mentioned in the (Embodiment 7-2), the stagnant areas of the ink become less compared to the cylindrical shape so as to curb printing defects such as variations in the discharge amount due to temperature rise of the ink in the stagnant areas. It is designed to eliminate he uneven portion 18 so that meniscus clipping on refilling is alleviated and the refill frequency becomes faster. Here, the cross section vertical to the flows in the first discharge port portion 16 and second discharge port portion 10 is not limited to the circle but may also be the ellipse, oval, polygon or nearly circular figure surrounded by the curve.

(Eighth Embodiment)

FIGS. 13A, 13B, 14A, 14B, 15A, 15B, 16A and 16B show the nozzle form of the ink jet record head according to the eighth embodiment of the present invention. FIGS. 13A, 14A, 15A and 16A are plan perspective views for viewing one of the plurality of nozzles of the ink jet record head from the vertical direction to the substrate, and FIGS. 13B, 14B, 15B and 16B are sectional views along lines 13B—13B, 14B—14B, 15B—15B and 16B—16B in FIGS. 13A, 14A, 15A and 16A, respectively.

The element substrate 2 and flow path composition substrate 3 of the ink jet record head according to this embodiment are the same as those according to the first embodiment. The nozzle form is formed so that the discharge port portion second axis 14 is deviated to the ink supply chamber side against the discharge port portion first axis 12 in the plan perspective views for viewing it from the vertical direction to the principal surface of the above described element substrate and the heater axis 15 matches with the above described discharge port portion second axis 14. Hereafter, the embodiment will be described by centering on the nozzle form.

There are the following advantages as to the placement wherein the discharge port portion first axis 12 and discharge port portion second axis 14 are deviated as described above and the discharge port portion second axis 14 matches with the heater axis 15. Matching the discharge port portion second axis 14 with the heater axis 15 has the advantage that the bubbling pressure generated by the electrothermal converting elements 1 is evenly conveyed to the second discharge port portion so as to sufficiently take in bubbling power. The heater axis 15 becomes closer to the ink supply chamber 6 compared to (the first embodiment) so that it has the effect of deviating the maximum bubbling position to the ink supply chamber 6 side and shortening the flow distance from the ink supply chamber 6 to the discharge port portion 20 and bubbling chamber 11 on refilling so as to render the refill frequency faster.

Hereafter, as for the eighth embodiment wherein the discharge port portion second axis 14 is deviated to the ink supply chamber 6 side against the discharge port portion first axis 12 and the discharge port portion second axis 14 matches with the heater axis 15, concrete examples will be taken while referring to the effects due to the differences in the form of the discharge port portion 20. Reference numeral 33 denotes an ink supply orifice and 35 denotes a taper portion in the drawings.

(Embodiment 8-1)

Figure 13A:
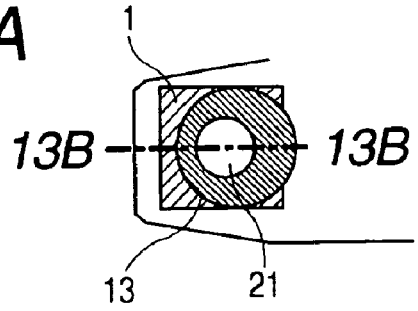
FIGS. 13A and 13B are first schematic diagrams of a nozzle structure of the ink jet record head according to an eighth embodiment of the present invention.
Figure 13B:
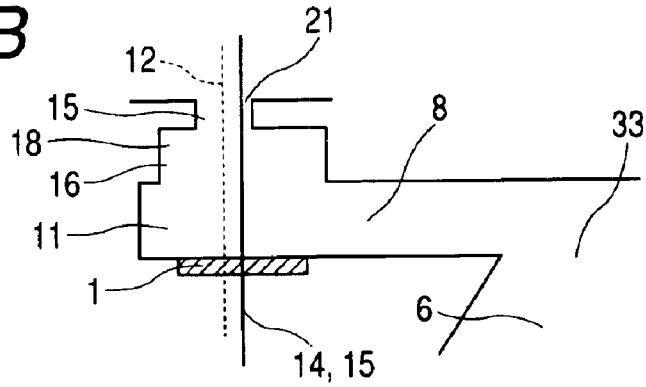

As for the nozzle form shown in FIGS. 13A and 13B, the discharge port portion 20 is formed by the first discharge port portion 16 and second discharge port portion 10 in increasing order of distance from the discharge port 11, and the sectional area in the plan perspective view for viewing it from the vertical direction to the principal surface of the element substrate 2 is formed to be larger in the second discharge port portion 10 than in the first discharge port portion 16.

It is possible, by rendering it in such a form, to reduce the flow resistance of the discharge port portion 20 so as to enhance the printing quality without reducing the discharge speed even if the discharge droplets are rendered smaller. Here, the cross section vertical to the flows in the first discharge port portion 16 and second discharge port portion 10 is not limited to the circle but may also be the ellipse, oval, polygon or nearly circular figure surrounded by the curve.

(Embodiment 8-2)

Figure 14A:
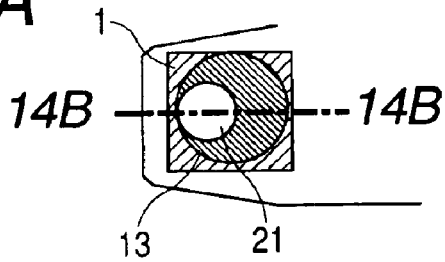
FIGS. 14A and 14B are second schematic diagrams of a nozzle structure of the ink jet record head according to an eighth embodiment of the present invention.
Figure 14B:
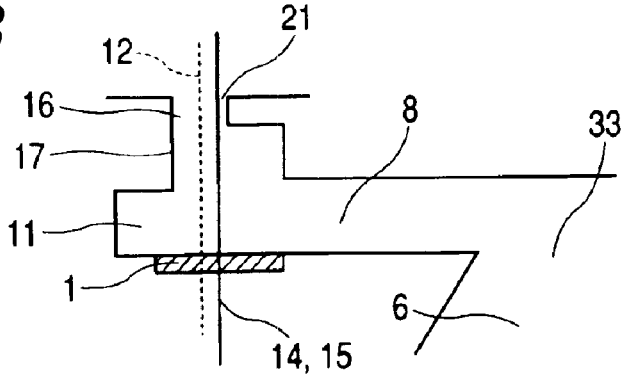

The nozzle form shown in FIGS. 14A and 14B is one of the variations of the (Embodiment 8-1). As for the nozzle form shown in FIGS. 14A and 14B, the first discharge port portion 16 is cylindrical and the second discharge port portion 10 is shaped like a truncated cone. It is possible, by shaping the second discharge port portion 10 like a truncated cone, to further reduce the flow resistance compared to the (Embodiment 8-1). Moreover, the uneven portion 18 between the first discharge port portion 16 and second discharge port portion 10 is reduced, and so the stagnant areas of the ink stagnating in the uneven portion 18 become less so that discharge amount, discharge speed and so on become stable and the printing quality is improved. It is because the ink stagnating in the uneven portion 18 is at a temperature higher than the surrounding ink due to the influence of being warmed by the electrothermal converting elements so that it changes viscosity resistance of the discharged ink and has negative effects on the discharge characteristics. Here, the cross section vertical to the flows in the first discharge port portion 16 and second discharge port portion 10 is not limited to the circle but may also be the ellipse, oval, polygon or nearly circular figure surrounded by the curve.

(Embodiment 8-3)

Figure 15A:
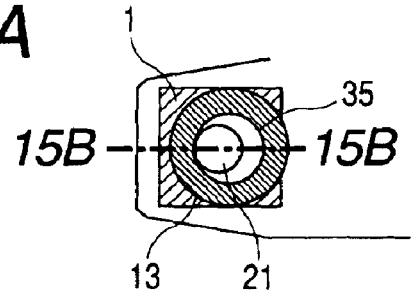
FIGS. 15A and 15B are third schematic diagrams of a nozzle structure of the ink jet record head according to an eighth embodiment of the present invention.
Figure 15B:
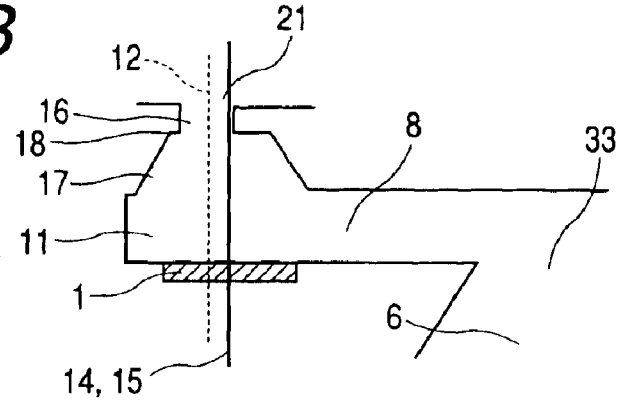

As for the nozzle form shown in FIGS. 15A and 15B, both the first discharge port portion 16 and second discharge port portion 10 are cylindrical, which is the same combination as the embodiment in FIGS. 13A and 13B. However, it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. Thus, compared to the (Embodiment 8-1), it has the effect of enhancing the refill frequency by reducing the clipping of the ink in the uneven portion 18. Here, the cross section vertical to the flows in the first discharge port portion 16 and second discharge port portion 10 is not limited to the circle but may also be the ellipse, oval, polygon or nearly circular figure surrounded by the curve.

(Embodiment 8-4)

Figure 16A:
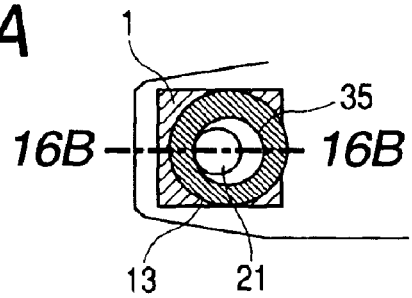
FIGS. 16A and 16B are fourth schematic diagrams of a nozzle structure of the ink jet record head according to an eighth embodiment of the present invention.
Figure 16B:
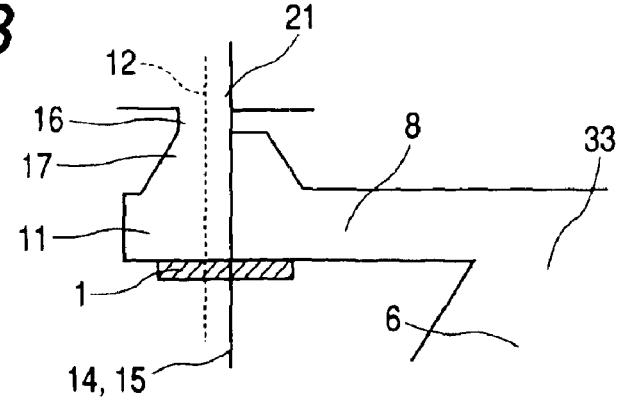

As for the nozzle form shown in FIGS. 16A and 16B, the first discharge port portion 16 is cylindrical and the second discharge port portion 10 is shaped like a truncated cone, and it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. If the second discharge port portion 10 is shaped like a truncated cone as mentioned in the (Embodiment 8-2), the stagnant areas of the ink become less compared to the cylindrical shape so as to curb printing defects such as variations in the discharge amount due to the temperature rise of the ink in the stagnant areas. It is designed to eliminate the uneven portion 18 so that meniscus clipping on refilling is alleviated and the refill frequency becomes faster. Here, the cross section vertical to the flows in the first discharge port portion 16 and second discharge port portion 10 is not limited to the circle but may also be the ellipse, oval, polygon or nearly circular figure surrounded by the curve.

(Ninth Embodiment)

FIGS. 17A, 17B, 18A, 18B, 19A, 19B, 20A and 20B show the nozzle form of the ink jet record head according to the ninth embodiment of the present invention. FIGS. 17A, 18A, 19A and 20A are plan perspective views for viewing one of the plurality of nozzles of the ink jet record head from the vertical direction to the substrate, and FIGS. 17B, 18B, 19B and 20B are sectional views along lines 17B—17B, 18B—18B, 19B—19B and 20B—20B in FIGS. 17A, 18A, 19A and 20A.

The element substrate 2 and flow path composition substrate 3 of the ink jet record head according to this embodiment are the same as those according to the first embodiment. The nozzle form is formed so that the discharge port portion second axis 14 is deviated to the ink supply chamber side against the discharge port portion first axis 12 in the plan perspective views for viewing it from the vertical direction to the principal surface of the above described element substrate and the discharge port portion second axis 14 is positioned between the discharge port portion first axis 12 and heater axis 15.

In terms of the relationship among the three axes, this embodiment is positioned between the first embodiment and second embodiment. According to the first embodiment, the discharge port portion first axis 12 matches with the heater axis 15 so that the bubbling pressure to the first discharge port portion 16 becomes even and the discharge becomes stable. According to the second embodiment, the discharge port portion second axis 14 matches with the heater axis 15 so that the bubbling pressure generated by the electrothermal converting elements 1 is evenly conveyed to a second discharge port 17 so as to sufficiently take in the bubbling power. There is also the advantage of deviating the maximum bubbling position to the ink supply chamber 6 side and further enhancing the refill frequency. This embodiment is the form for incorporating the advantages of these two embodiments respectively.

Hereafter, as for the ninth embodiment wherein the discharge port portion second axis 14 is deviated to the ink supply chamber 6 side against the discharge port portion first axis 12 and the heater axis 15 is positioned between the discharge port portion first axis 12 and the discharge port portion second axis 14, concrete examples will be taken while referring to the effects due to the differences in the form of the discharge port portion 20. Reference numeral 33 denotes an ink supply orifice and 35 denotes a taper portion in the drawings.

(Embodiment 9-1)

Figure 17A:
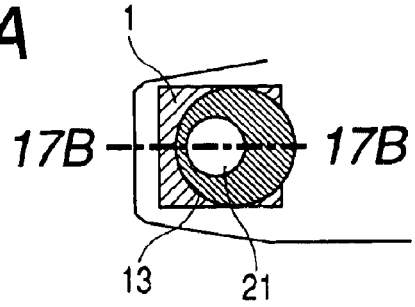
FIGS. 17A and 17B are first schematic diagrams of a nozzle structure of the ink jet record head according to a ninth embodiment of the present invention.
Figure 17B:
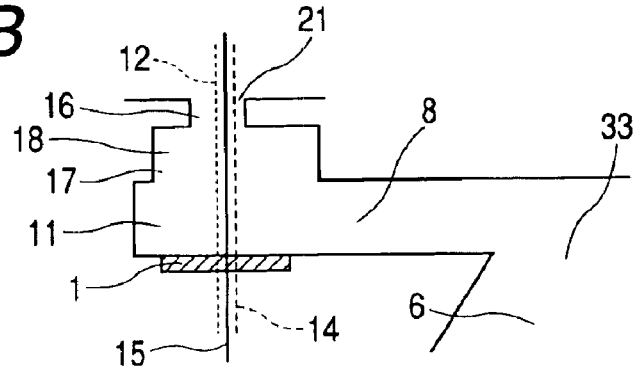

As for the nozzle form shown in FIGS. 17A and 17B, the discharge port portion 20 is formed by the first discharge port portion 16 and second discharge port portion 10 in increasing order of distance from the discharge port 11, and the sectional area in the plan perspective view for viewing it from the vertical direction to the principal surface of the element substrate 2 is formed to be larger in the second discharge port portion 10 than in the first discharge port portion 16.

It is possible, by rendering it in such a form, to reduce the flow resistance of the discharge port portion 20 so as to enhance the printing quality without reducing the discharge speed even if the discharge droplets are rendered smaller. Here, the cross section vertical to the flows in the first discharge port portion 16 and second discharge port portion 10 is not limited to the circle but may also be the ellipse, oval, polygon or nearly circular figure surrounded by the curve.

(Embodiment 9-2)

Figure 18A:
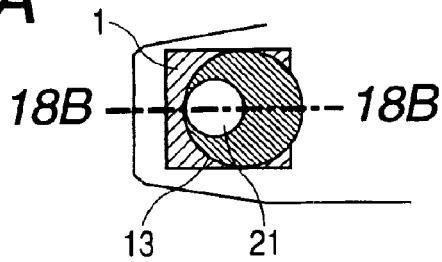
FIGS. 18A and 18B are second schematic diagrams of a nozzle structure of the ink jet record head according to a ninth embodiment of the present invention.
Figure 18B:
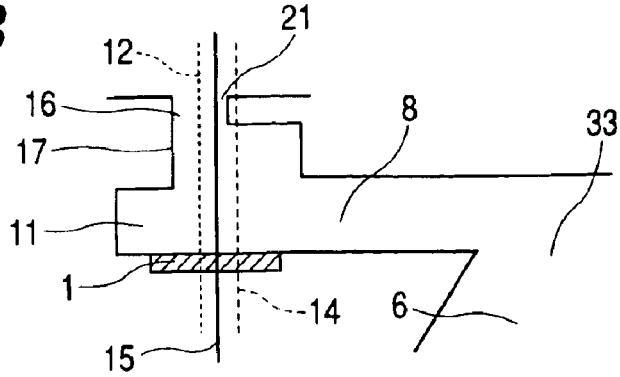

The nozzle form shown in FIGS. 18A and 18B is one of the variations of the (Embodiment 9-1). As for the nozzle form shown in FIGS. 18A and 18B, the first discharge port portion 16 is cylindrical and the second discharge port portion 10 is shaped like a truncated cone. It is possible, by shaping the second discharge port portion 10 like a truncated cone, to further reduce the flow resistance compared to the (Embodiment 9-1). Moreover, the uneven portion 18 between the first discharge port portion 16 and second discharge port portion 10 is reduced, and so the stagnant areas of the ink stagnating in the uneven portion 18 become less so that discharge amount, discharge speed and so on become stable and the printing quality is improved. It is because the ink stagnating in the uneven portion 18 is at a temperature higher than the surrounding ink due to the influence of being warmed by the electrothermal converting elements so that it changes viscosity resistance of the discharged ink and has negative effects on the discharge characteristics. Here, the cross section vertical to the flows in the first discharge port portion 16 and second discharge port portion 10 is not limited to the circle but may also be the ellipse, oval, polygon or nearly circular figure surrounded by the curve.

(Embodiment 9-3)

Figure 19A:
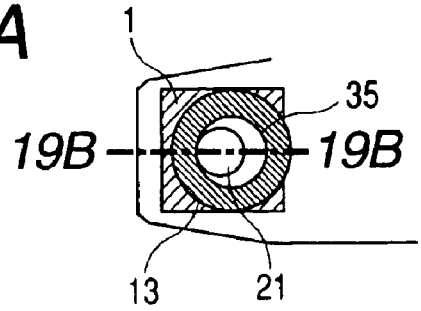
FIGS. 19A and 19B are third schematic diagrams of a nozzle structure of the ink jet record head according to a ninth embodiment of the present invention.
Figure 19B:
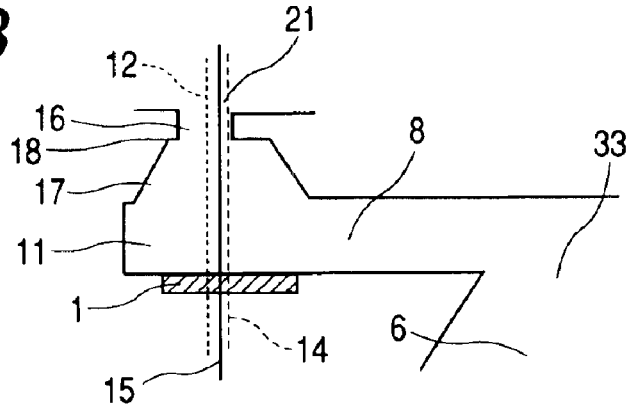

As for the nozzle form shown in FIGS. 19A and 19B, both the first discharge port portion 16 and second discharge port portion 10 are cylindrical, which is the same combination as the embodiment in FIGS. 17A and 17B. However, it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. Thus, compared to the (Embodiment 9-1), it has the effect of enhancing the refill frequency by reducing the clipping of the ink in the uneven portion 18. Here, the cross section vertical to the flows in the first discharge port portion 16 and second discharge port portion 10 is not limited to the circle but may also be the ellipse, oval, polygon or nearly circular figure surrounded by the curve.

(Embodiment 9-4)

Figure 20A:
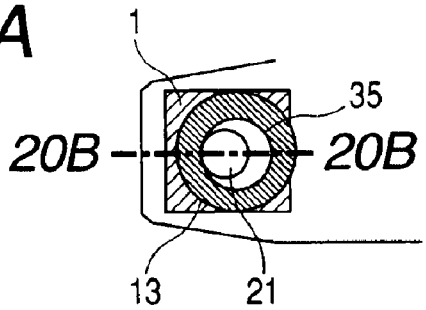
FIGS. 20A and 20B are fourth schematic diagrams of a nozzle structure of the ink jet record head according to a ninth embodiment of the present invention.
Figure 20B:
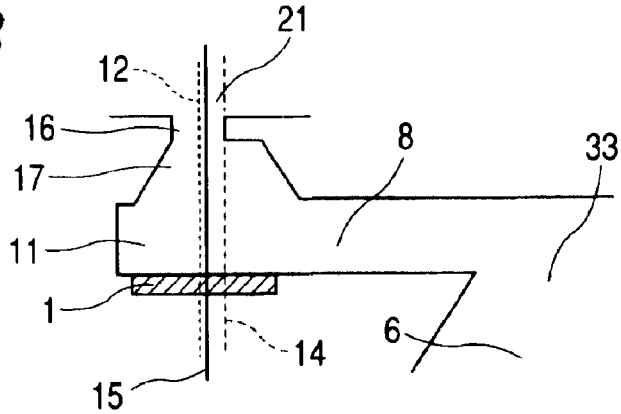

As for the nozzle form shown in FIGS. 20A and 20B, the first discharge port portion 16 is cylindrical and the second discharge port portion 10 is shaped like a truncated cone, and it is formed so that the uneven portion 18 between the first discharge port portion 16 and second discharge port portion 10 on the opposite side of the ink supply chamber 6 is not generated in the plan perspective view for viewing it from the vertical direction to the principal surface of the element substrate 2. If the second discharge port portion 10 is shaped like a truncated cone as mentioned in the (Embodiment 9-2), the stagnant areas of the ink become less compared to the cylindrical shape so as to curb printing defects such as variations in the discharge amount due to temperature rise of the ink in the stagnant areas. It is designed to eliminate the uneven portion 18 so that the meniscus clipping on refilling is alleviated and the refill frequency becomes faster. Here, the cross section vertical to the flows in the first discharge port portion 16 and second discharge port portion 10 is not limited to the circle but may also be the ellipse, oval, polygon or nearly circular figure surrounded by the curve.

What is claimed is:

1. An ink jet record head comprising:

said head has:

a flow path composition substrate having a plurality of nozzles through which liquid flows, a supply chamber for supplying the liquid to each of the nozzles, and a plurality of discharge ports which are nozzle end openings for discharging a liquid droplet, said nozzle comprised of a bubbling chamber in which bubble is generated by a discharge energy generating element for generating thermal energy for discharging the liquid droplet, discharge port portions including said discharge ports and communicating between said discharge ports and said bubbling chamber, and a supply path for supplying the ink to the bubbling chamber; and an element substrate on which said discharge energy generating element is provided and joining said flow path composition substrate with a principal surface, wherein said discharge port portion has:

a first discharge port portion including said discharge port and having a cross section approximately constant against a discharge axis; and a second discharge port portion contiguous to the first discharge port portion with an uneven portion and communicating with said bubbling chamber while having the cross section parallel with the principal surface of said element substrate and larger than the cross section of the first discharge port portion, and a distance of the uneven portion farthest from a supply direction of said second discharge port portion is shorter than the distance of said uneven portion in an arrangement direction of said discharge ports.

2. The ink jet record head according to claim 1, wherein an opening face on said first discharge port portion side of said second discharge port portion intersecting said discharge axis is a sectional shape congruent with the opening face on said bubbling chamber side of said second discharge port portion intersecting said discharge axis, and on any cross section going through the center of said discharge port and vertical to the principal surface of said element substrate, a side wall of said second discharge port portion is represented by a straight line, and the opening face on said first discharge port portion side of said second discharge port portion, the opening face on said bubbling chamber side thereof and the principal surface of said element substrate are parallel.

3. The ink jet record head according to claim 2, wherein the bubbles generated by said discharge energy generating element communicate with the outside air.

4. The ink jet record head according to claim 1, wherein an opening face on said first discharge port portion side of said second discharge port portion intersecting said discharge axis is a similar figure to the opening face on said bubbling chamber side of said second discharge port portion and is also a sectional shape of smaller area than the opening face on the bubbling chamber side, and on any cross section going through the center of said discharge port and vertical to the principal surface of said element substrate, a side wall of said second discharge port portion is represented by a straight line, and the opening face on said first discharge port portion side of said second discharge port portion, the opening face on said bubbling chamber side thereof and the principal surface of said element substrate are parallel.

5. The ink jet record head according to claim 4, wherein the opening face on said first discharge port portion side of said second discharge port portion intersecting said discharge axis and the opening face on said bubbling chamber side thereof are ellipses or ovals.

6. The ink jet record head according to claim 5, wherein the opening face on said first discharge port portion side of said second discharge port portion intersecting said discharge axis is inscribed in said discharge port portion at two points.

7. The ink jet record head according to claim 6, wherein the bubbles generated by said discharge energy generating element communicate with the outside air.

8. The ink jet record head according to claim 5, wherein the bubbles generated by said discharge energy generating element communicate with the outside air.

9. The ink jet record head according to claim 4, wherein the bubbles generated by said discharge energy generating element communicate with the outside air.

10. The ink jet record head according to claim 1, wherein the opening face on said bubbling chamber side of said second discharge port portion intersecting the discharge axis is an ellipse or an oval and the opening face on the first discharge port portion side of said second discharge port portion is rendered as a circle and inside the ellipse or oval which is the opening face on the bubbling chamber side of said second discharge port portion, and on any cross section going through the center of said discharge port and vertical to the principal surface of said element substrate, a side wall of said second discharge port portion is represented by a straight line, and the opening face on said first discharge port portion side of said second discharge port portion, the opening face on said bubbling chamber side thereof and the principal surface of said element substrate are parallel.

11. The ink jet record head according to claim 10, wherein the opening face on the first discharge port portion side of said second discharge port portion is a circle congruent with the opening face on said bubbling chamber side of said first discharge port portion in a plan perspective view for viewing it from a vertical direction to the principal surface of said element substrate.

12. The ink jet record head according to claim 11, wherein the bubbles generated by said discharge energy generating element communicate with the outside air.

13. The ink jet record head according to claim 10, wherein the bubbles generated by said discharge energy generating element communicate with the outside air.

14. The ink jet record head according to claim 1, wherein said nozzles are formed by orthogonalizing a discharge direction in which liquid droplets fly from the discharge port and a flow direction of the liquid flowing in said supply path.

15. The ink jet record head according to claim 14, wherein the bubbles generated by said discharge energy generating element communicate with the outside air.

16. The ink jet record head according to claim 1, wherein said flow path composition substrate has a plurality of said discharge energy generating elements and a plurality of said nozzles, and is equipped with a first nozzle array having the nozzles in a longitudinal direction arranged in parallel and a second nozzle array having the nozzles in the longitudinal direction arranged in parallel at positions opposed to the first nozzle array across said supply chamber respectively while the nozzles in the second nozzle array are arranged so that the pitches among the adjacent nozzles are mutually deviated by a ½ pitch against the nozzles in the first nozzle array.

17. The ink jet record head according to claim 16, wherein the bubbles generated by said discharge energy generating element communicate with the outside air.

18. The ink jet record head according to claim 1, wherein the bubbles generated by said discharge energy generating element communicate with the outside air.

* * * * *